US012716412B2

(12) United States Patent
Kemp et al.

(10) Patent No.: US 12,716,412 B2
(45) Date of Patent: Aug. 25, 2026

(54) FLUID RETENTION APPARATUS FOR FLUID END OF POSITIVE DISPLACEMENT PUMP AND RELATED METHOD

(71) Applicant: Anthony Steven Froehler, Calgary (CA)

(72) Inventors: Matthew Edward Kemp, Calgary (CA); Anthony Steven Froehler, Calgary (CA)

(73) Assignee: Anthony Steven Froehler, Calgary (CA)

( * ) Notice: Subject to any disclaimer, the term of this patent is extended or adjusted under 35 U.S.C. 154(b) by 40 days.

(21) Appl. No.: 18/355,101

(22) Filed: Jul. 19, 2023

(65) Prior Publication Data

US 2025/0027492 A1 Jan. 23, 2025

Related U.S. Application Data

(60) Provisional application No. 63/343,837, filed on May 19, 2022.

(51) Int. Cl.
*F04B 53/02* (2006.01)
*F04B 19/22* (2006.01)
(Continued)

(52) U.S. Cl.
CPC ..... *F04B 53/02* (2013.01); *F04B 53/164* (2013.01); *F04B 19/22* (2013.01); *F04B 35/04* (2013.01);
(Continued)

(58) Field of Classification Search
CPC ..... F04B 53/02; F04B 53/16; F04B 53/164; F04B 19/22; F04B 35/04; F04B 53/008;
(Continued)

(56) References Cited

U.S. PATENT DOCUMENTS

2023/0047066 A1* 2/2023 Barnett ..... F04B 1/0448

FOREIGN PATENT DOCUMENTS

CN 105822518 A * 8/2016
CN 113719447 A * 11/2021 ..... F04B 53/02

OTHER PUBLICATIONS

CN105822518A translation (Year: 2025).*
CN113719447A translation (Year: 2025).*

* cited by examiner

*Primary Examiner* — David N Brandt
(74) *Attorney, Agent, or Firm* — Chris Dynowski; Bhole IP Law

(57) ABSTRACT

A fluid retention apparatus for a positive displacement pump used to transfer fluid from a supply to a target comprises (i) a sealing device configured to be received in a packing chamber of the pump and to matably receive a piston of the pump therethrough that reciprocates in a transfer chamber for generating suction and expulsion of the fluid for transference thereof, and (ii) a leak containment device configured to contain leaked fluid passed from the transfer chamber. The sealing device features a tubular body made of wearable and substantially deformation-resistant composite polymer material and the passageway which is shaped with opposite end portions of reduced diameter to form a sealing friction fit with the piston. The leak containment device features a cavity fluidically communicated with the sealing device's passageway and receiving the piston therethrough, and a drain port in fluidic communication with the cavity for releasing the leaked fluid.

14 Claims, 8 Drawing Sheets

(51) Int. Cl.

| | |
|---|---|
| ***F04B 35/04*** | (2006.01) |
| ***F04B 53/00*** | (2006.01) |
| ***F04B 53/04*** | (2006.01) |
| ***F04B 53/06*** | (2006.01) |
| ***F04B 53/16*** | (2006.01) |

(52) U.S. Cl.
CPC ..... *F04B 53/008* (2013.01); *F04B 53/04* (2013.01); *F04B 53/06* (2013.01); *F04B 53/168* (2013.01)

(58) Field of Classification Search
CPC ..... F04B 53/04; F04B 53/06; F04B 53/166; F04B 53/168; F04B 53/143
See application file for complete search history.

FLUID RETENTION APPARATUS FOR FLUID END OF POSITIVE DISPLACEMENT PUMP AND RELATED METHOD

This application claims the benefit under 35 U.S.C. 119(e) of U.S. provisional application Ser. No. 63/343,837, filed May 19, 2022, which is incorporated by reference herein.

FIELD OF THE INVENTION

The present invention relates generally to a fluid retention apparatus for a plunger in a fluid end of a positive displacement pump, such as a chemical injection pump, that acts to transfer fluid from a supply to a target, and more particularly to a sealing device configured to carry one or more biasing devices for applying radial pressure on the body to form a seal around the plunger and a containment device configured to receive fluid that has leaked past the seal.

BACKGROUND

Typically, a chemical injection pump used in the oil/gas industry is a positive displacement-type pump with a fluid end mounted in operative association with a piston of the pump to transfer fluid in the form of a chemical from a supply container to a target vessel, such as a pipeline or a well. One common type of fluid end is referred to in industry as a 5100 series fluid end, in which an inlet arranged for fluidically connecting to the supply, an outlet arranged for fluidically connecting to the target and a piston or packing chamber are oriented in a T-shaped configuration in which the inlet and outlet are in substantially linearly opposite, upstanding relation and the piston chamber is intermediate the inlet and outlet and disposed to one side thereof, such that the 'T' is on its side. The piston acts as a plunger relative to the fluid end for generating changes in fluidic pressure in a chamber intermediate the inlet and outlet. The piston generates suction on a retraction stroke relative to the transfer chamber and expulsion on an extension stroke relative thereto.

Conventionally, a series of packing rings in the form of elastomeric gaskets, and of chevron-shaped cross-section act to form the seal around the piston. (These packing rings are conventionally referred to in industry as V-rings.) Pressure of the seal around the plunger can be varied by adjusting compression of the stacked series of chevron rings. As the piston/plunger reciprocates, the packing rings wear. Therefore, in order to maintain consistent sealing performance, so as to prevent leaks out of the transfer chamber, an axial compression of the stacked series of packing rings is adjusted, specifically increased. As such, it is desirable to continuously monitor the fluid end and to adjust compression of the packing rings over time.

Furthermore, elastomers, that is the constituent material of the packing rings, are generally suited for one or a small range of chemicals that are processed using a chemical injection pump. Therefore, when the same pump is switched from pumping a first type of chemical to a different type of chemical, the packing rings are replaced so as to provide sealing action on the plunger against a specific type of chemical to be processed by the pump.

SUMMARY OF THE INVENTION

According to an aspect of the invention there is provided a fluid retention apparatus for a positive displacement pump, wherein the positive displacement pump has:

a piston extending along an axis between opposite ends thereof, wherein the piston is substantially cylindrical and has an outer surface having a diameter transverse to the axis;

a prime mover operatively connected to the piston and configured to displace the piston in reciprocating linear movement along the axis of the piston;

a fluidic interconnection device configured to fluidically interconnect a supply having a fluid to be pumped, a target for receiving the fluid and the piston to effect the transfer from the supply to the target, wherein the fluidic interconnection device includes a housing, an inlet port supported by the housing and configured for fluidic communication with the supply and an outlet port supported by the housing and configured for fluidic communication with the target, wherein the fluidic interconnection device is configured to provide a flow of the fluid through the housing from the inlet port to the outlet port;

wherein the fluidic interconnection device further includes a transfer chamber in the housing intermediate the inlet and outlet ports relative to the flow of the fluid through the housing for receiving the piston in the reciprocating linear movement thereof, whereby the piston acts a plunger to transfer the fluid from the supply to the target;

wherein the fluidic interconnection device further includes a packing chamber adjacent the transfer chamber and remote to the flow of the fluid for receiving a sealing body to fluidically seal the transfer chamber at an interface with the piston, wherein the piston passes through the packing chamber and into the transfer chamber to provide an end portion of the piston defining a terminal end thereof, distal to the prime mover, for movement within the transfer chamber;

the fluid retention apparatus comprising:

a tubular body forming the sealing body and extending along an axis from a first end to a second end, wherein the tubular body is configured for insertion into the packing chamber;

wherein the tubular body is made from a composite polymeric material which is wearable and substantially resistant to deformation under mechanical pressure;

a passageway in the tubular body and extending along the axis thereof, wherein the passageway opens at the first and second ends of the tubular body and is configured to substantially matably receive the piston therethrough, wherein the passageway comprises a first end portion at the first end of the tubular body, a second end portion at the second end of the tubular body and an intermediate portion therebetween, wherein the intermediate portion is generally cylindrical and the first and second end portions have reduced diameter relative thereto, wherein a diameter of the intermediate portion is sized larger than the diameter of the piston to form a circumferential gap between the intermediate portion of the passageway and the piston, wherein prescribed diameters of the first and second end portions are sized smaller than the diameter of the piston such that the first and second end portions form seals around the piston by friction fit to resist passage of the fluid;

annular recesses in the first and second ends of the tubular body between openings of the passageway and an outer surface of the tubular body arranged to face an interior surface of the packing chamber, wherein each of the annular recesses has a base spaced from a corresponding one of the first and second ends of the tubular body in an axial direction of the tubular body and opposite sidewalls interconnecting the base and the corresponding one of the first and second ends and which are spaced apart in a diametric direction of the tubular body;

a biasing device configured to be located in the annular recess in the first end, wherein the biasing device has opposite sides configured to be urged apart when the biasing device is in a biased condition;

wherein, in the annular recess in the first end, the biasing device is arranged in the biased condition with the opposite sides thereof arranged to engage the sidewalls of said annular recess to exert force thereon directed radially of the tubular body, whereby the first end portion of the passageway is urged radially inwardly to exert pressure on the piston to enhance the seal therearound to resist leakage of the fluid from the transfer chamber and into the passageway of the tubular body; and a sealing gasket disposed in the annular recess in the second end and configured to form a fluidic seal with a downstream closure component configured to retain the sealing body in the packing chamber.

This provides an arrangement for sealing the piston against flow of the fluid through the passageway of the sealing body in a manner which self-increases sealing pressure as an inner surface of the passageway, particularly at the first end portion, wears during reciprocal movement of the piston.

Preferably, the composite polymeric material comprises polytetrafluoroethylene substantially reinforced with carbon.

In the illustrated arrangement, the prescribed diameter of the first end portion is smaller than the prescribed diameter of the second end portion.

In the illustrated arrangement, the first and second end portions are tapered from the diameter of the intermediate portion to the prescribed diameters thereof.

In the illustrated arrangement, the first end portion is tapered over a larger axial distance than the second end portion.

In the illustrated arrangement, an end portion of the outer surface of the tubular body at the first end is flared outwardly to seal with the packing chamber by friction fit.

In the illustrated arrangement, the tubular body further includes one or more annular recesses at axially spaced locations on the outer surface of the tubular body and one or more sealing gaskets received therein and arranged for engaging the packing chamber.

In the illustrated arrangement, the fluid retention apparatus further includes a leak containment device forming the downstream closure component, wherein the leak containment device forms a cavity configured to receive the piston therethrough and for fluidic communication with the passageway of the tubular body and to receive the fluid that has leaked into the passageway from the transfer chamber, wherein the cavity extends along an axis from an open end arranged in fluidic communication with the passageway of the tubular body and a substantially closed end forming a substantially sealed interface with the piston, and wherein the leak containment device includes a drain port in fluidic communication with the cavity and configured for selectively communicating the cavity with an external vessel for receiving the fluid that has leaked.

Preferably, the drain port forms a passageway in communication with the cavity and extending transversely relative to the axis of the leak containment device arranged to be coaxial with the axis of the tubular body.

Preferably, the leak containment device comprises a first fixed portion and a second rotatable portion collectively forming the cavity, wherein the first fixed portion forms an opening of the cavity configured for fluidic communication with the second opening of the passageway, wherein the first fixed portion has an axis arranged to be oriented coaxially with the axis of the tubular body, wherein the second rotatable portion locates the drain port which is disposed at a radially spaced location from the axis of the first fixed portion, and wherein the second rotatable portion is rotatably supported on the first fixed portion for rotation around the axis thereof to reposition the drain port angularly of the axis of the first fixed portion.

Preferably, when the positive displacement pump includes a pump housing receiving the prime mover and a mounting member for supporting the fluidic interconnection device in fixed relation to the piston and configured for attaching to the pump housing, and when the mounting member further forms a tubular wall encompassing the leak containment device, the mounting member includes an opening in the tubular wall for accessing the drain port.

According to another aspect of the invention there is provided a fluid retention apparatus for a positive displacement pump, wherein the positive displacement pump has:

a piston extending along an axis between opposite ends thereof;

a prime mover operatively connected to the piston and configured to displace the piston in reciprocating linear movement along the axis of the piston;

a fluidic interconnection device configured to fluidically interconnect a supply having a fluid to be pumped, a target for receiving the fluid and the piston to effect the transfer from the supply to the target, wherein the fluidic interconnection device includes a housing, an inlet port supported by the housing and configured for fluidic communication with the supply and an outlet port supported by the housing and configured for fluidic communication with the target, wherein the fluidic interconnection device is configured to provide a flow of the fluid through the housing is defined from the inlet port to the outlet port;

wherein the fluidic interconnection further includes a transfer chamber in the housing intermediate the inlet and outlet ports relative to the flow of the fluid through the housing for receiving the piston in the reciprocating linear movement thereof, whereby the piston acts a plunger to transfer the fluid from the supply to the target;

wherein the fluidic interconnection further includes a packing chamber adjacent the transfer chamber and remote to the flow of the fluid for receiving a sealing body to fluidically seal the transfer chamber at an interface with the piston, wherein the piston passes through the packing chamber and into the transfer chamber to provide an end portion of the piston defining a terminal end thereof, distal to the prime mover, for movement within the transfer chamber;

wherein the sealing body is configured for insertion into the packing chamber and forming a passageway configured to sealably receive the piston therethrough;

the fluid retention apparatus comprising:

a housing arranged to be adjacent the sealing body and in opposite relation to the transfer chamber;

a cavity in the housing configured to receive the piston therethrough and for fluidic communication with the passageway of the sealing body and to receive the fluid that has leaked into the passageway from the transfer chamber, wherein the cavity extends along an axis from an open end arranged in fluidic communication with the passageway of the sealing body and a substantially closed end forming a substantially sealed interface with the piston; and a drain port in fluidic communication with the cavity and configured for selectively communicating the cavity with an external vessel for receiving the fluid that has leaked.

This provides an arrangement for containing leaked fluid to prevent spills thereof into an ambient environment of the pump.

In the illustrated arrangement, the drain port forms a passageway in communication with the cavity and extending transversely relative to the axis of the housing arranged to be coaxial with the axis of the sealing body.

In the illustrated arrangement, the housing comprises a first fixed portion and a second rotatable portion collectively forming the cavity, wherein the first fixed portion defines the open end and the second rotatable portion locates the drain port which is disposed at a radially spaced location from the axis of the housing, and wherein the second rotatable portion is rotatably supported on the first fixed portion for rotation around the axis of the fixed portion to reposition the drain port angularly thereof.

In the illustrated arrangement, when the positive displacement pump includes a pump housing receiving the prime mover and a mounting member for supporting the fluidic interconnection device in fixed relation to the piston and configured for attaching to the pump housing, and when the mounting member further forms a tubular wall encompassing the leak containment device, the mounting member includes an opening in the tubular wall for accessing the drain port.

According to another aspect of the invention there is provided a method for containing fluid during transfer from a supply to a target using a positive displacement pump, wherein the positive displacement pump has a plunger and a transfer chamber disposed intermediate the supply and the target relative to a flow of the fluid therebetween, and wherein the plunger is received in the transfer chamber and movable relative thereto in reciprocating movement to draw the fluid into the transfer chamber and discharge the fluid therefrom, the method comprising:

resisting, using a sealing device received coaxially of the plunger outside the transfer chamber, leakage of the fluid out of the transfer chamber, wherein the sealing device has a passageway through which the plunger is passed and which is in frictional circumferential engagement with an outer surface of the plunger to form a seal therearound; and guiding, using a fluid-conveying component in fluidic communication with the passageway of the sealing device and remote to the transfer chamber, a leaked portion of the fluid to an external vessel to be contained therein.

In this manner, the pumping system is closed, including with respect to leaked fluid.

In one arrangement, the external vessel is the supply such that the leaked portion of the fluid is reintroduced for subsequent transfer to the target.

According to another aspect of the invention there is provided a method of forming a seal around a piston of a pump, which generally comprises:

providing a tubular body with a passageway made of a wearable composite polymeric material, wherein the passageway is sized to substantially matably receive the piston and wherein end portions of the passageway are sized smaller in diameter than the piston;

forcibly passing the piston through the passageway to stretch a peripheral wall of the passageway such that portions of end portions of the passageway substantially conform to the piston thereby forming seals with the piston.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

The accompanying figures show a fluid retention apparatus 100 for a positive displacement pump 10 arranged to transfer fluid from a supply 1 having or containing the fluid to a target 2 to receive the fluid. Such pumping systems are commonplace in the oil/gas industry, where the pump is referred to as an injection pump and the fluid to be pumped is a chemical in a liquid state. The supply 1 and the target 2 are vessels or containers configured to receive fluid. Typically, the supply is an above-ground vessel and the target may be an above-ground vessel or a subterranean vessel such as a pipeline or wellbore.

Figure 1:
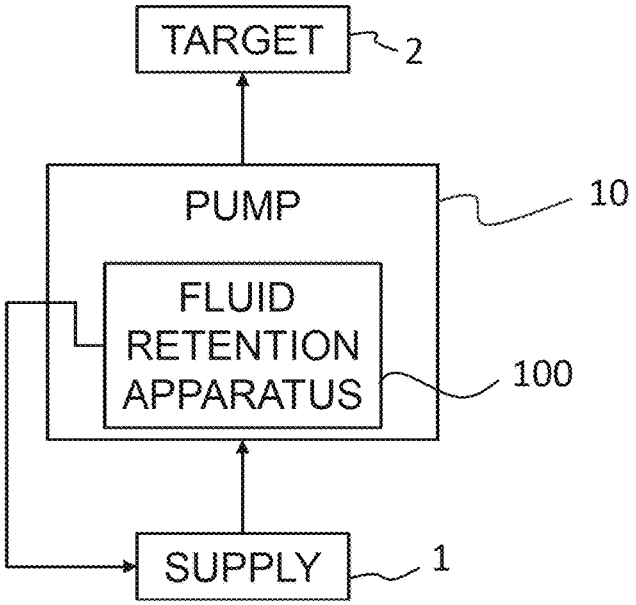
FIG. 1 is a schematic diagram of a fluid pumping system.
Figure 2:
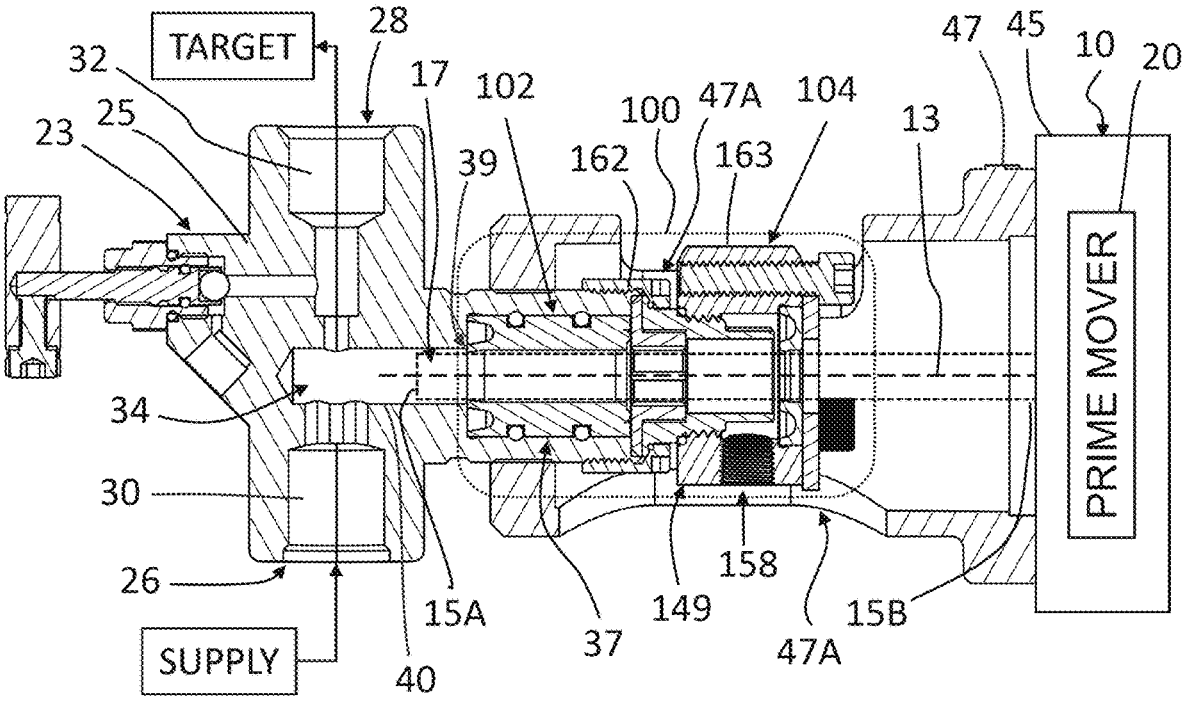
FIG. 2 is an axial sectional view of a fluidic interconnection device of a positive displacement pump and an arrangement of fluid retention apparatus according to the present invention, as if it were taken along line 2-2 in FIG. 4.

Generally speaking, and referring to FIG. 2, the positive displacement pump 10 comprises a piston 12 (shown in phantom in FIG. 2 for clarity of illustration) extending along an axis 13 between opposite ends 15A, 15B thereof. Typically, the piston is substantially cylindrical in shape, specifically circular cylindrical, and has an outer surface 17 having a diameter $D_P$ transverse to the axis 13.

The pump 10 further comprises a prime mover 20 operatively connected to the piston 12 and configured to displace the piston in reciprocating linear movement along the axis 13 of the piston. For example, the prime mover 20 is in the form of an electric motor and there is provided a transmission (not shown) operatively interconnecting the motor and the piston to convert mechanical rotation output by the motor to reciprocating linear movement for reciprocating axial displacement of the piston.

Still referring to FIG. 2, the pump 10 includes a fluidic interconnection device 23 configured to fluidically interconnect the supply 1, the target 2 and the piston 12 to effect the transfer from the supply to the target. The fluidic interconnection device 23 includes a housing 25, an inlet port 26 configured for fluidic communication with the supply 1 and an outlet port 28 configured for fluidic communication with the target 2. The fluidic interconnection device is configured to provide a flow of the fluid through the housing 25 from the inlet port 26 to the outlet port 28. This is achieved by providing an inlet-side valve assembly 30 (schematically shown) configured to permit unidirectional fluid flow from the inlet port 26 and into the housing 25 and an outlet-side valve assembly 32 (schematically shown) configured to permit unidirectional fluid flow from within the housing and to the outlet port 28. Each of the valve assemblies has one or more constituent components depending on the fluid to be pumped and conditions, for example pressure, at which the pumping takes place.

The fluidic interconnection device 23 further includes a transfer chamber 34 in the housing intermediate the inlet and outlet ports 26, 28 relative to the flow of the fluid through the housing 25 for receiving the piston 12 in the reciprocating linear movement, whereby the piston acts a plunger to transfer the fluid from the supply to the target. In the illustrated arrangement, the transfer chamber 34 is elongated in the axis of the piston or the reciprocal movement thereof, and is offset relative to the inlet and outlet ports 26, 28 which lie along a common axis perpendicularly transverse to the piston axis 13. Furthermore, the chamber is substantially cylindrical, like the piston, and substantially corresponds in shape to the piston, such that the piston snugly fits into the transfer chamber.

Yet further, the fluidic interconnection device further includes a packing chamber 37 adjacent the transfer chamber 34 and remote to the flow of the fluid through the housing for receiving a sealing body, in this case that indicated at 102, to fluidically seal the transfer chamber 34 at an interface with the piston 12. That is, the transfer chamber 34 is open at one end 39 thereof, distal to the inlet and outlet, and through which the piston 12 passes, and since it is desired for the fluid to flow downstream from the transfer chamber 34 and to the target at the outlet 28 of the pump, a gap between the piston 12 and opposite, axially-extending walls of the transfer chamber 34 is closed for fluidic sealing. As such, the piston 12 passes through the packing chamber 37 and into the transfer chamber 34 to provide an end portion 41 of the piston defining a terminal end 15A thereof, distal to the prime mover 20, for movement within the transfer chamber 34. Generally, the terminal end 15A is free as it is detached from any other element.

Since the transfer chamber 34 substantially corresponds in cross-sectional shape to the piston, the terminal end 15A acts to form a movable wall of the chamber 34 movable relative to an opposite end wall which is formed by the housing and therefore is fixed, and which accordingly provides a variable volume to the transfer chamber. In this manner, varying the volume acts to draw and expel or discharge fluid from the transfer chamber for transfer from the inlet to the outlet. Suction is generated on a retraction stroke of the piston whereby the variable volume chamber increases or enlarges in volume to draw fluid into the transfer chamber 34, and expulsion is generated on an extension stroke of the piston whereby the variable volume chamber decreases in volume to expel or push the fluid out of the transfer chamber 34. Prescribed positioning of the inlet and outlet valve assemblies 30, 32, that is opening or closing of corresponding ones thereof, along with a corresponding one of the stroke, provides the desired directionality of the flow of fluid through the transfer chamber 34. That is, the plunger is received in the transfer chamber and movable relative thereto in reciprocating movement to draw the fluid into the transfer chamber and discharge the fluid therefrom.

It will be appreciated that the fluidic interconnection device 23 is commonly referred to in industry as a fluid end.

Figure 3:
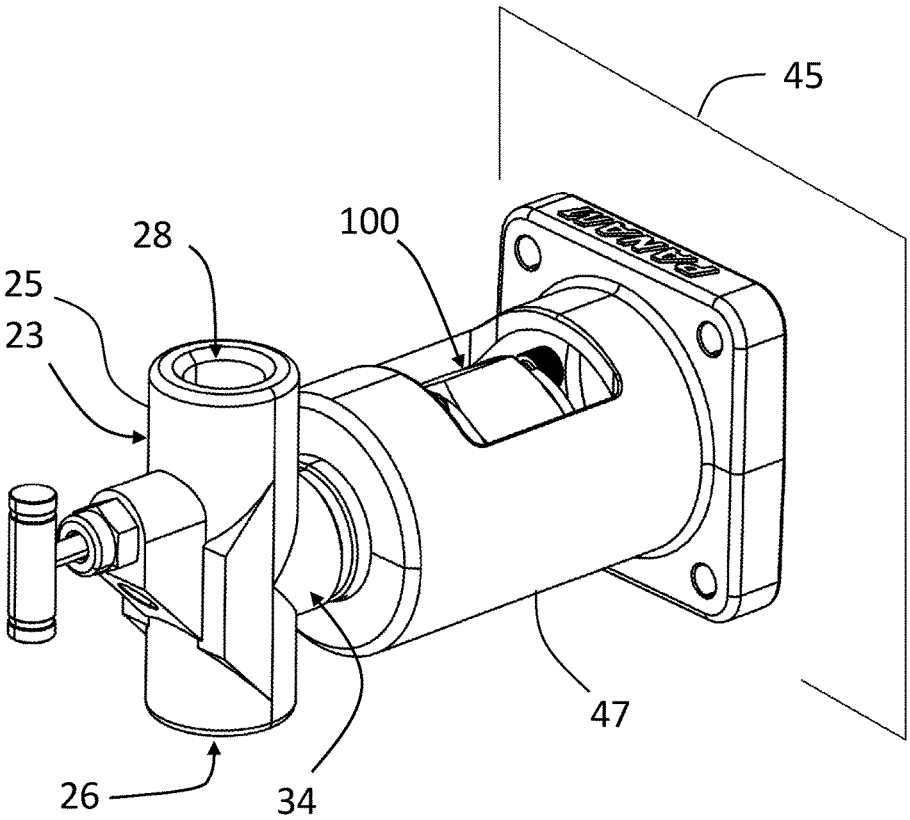
FIG. 3 is a perspective view of the fluidic interconnection device of FIG. 2.
Figure 4:
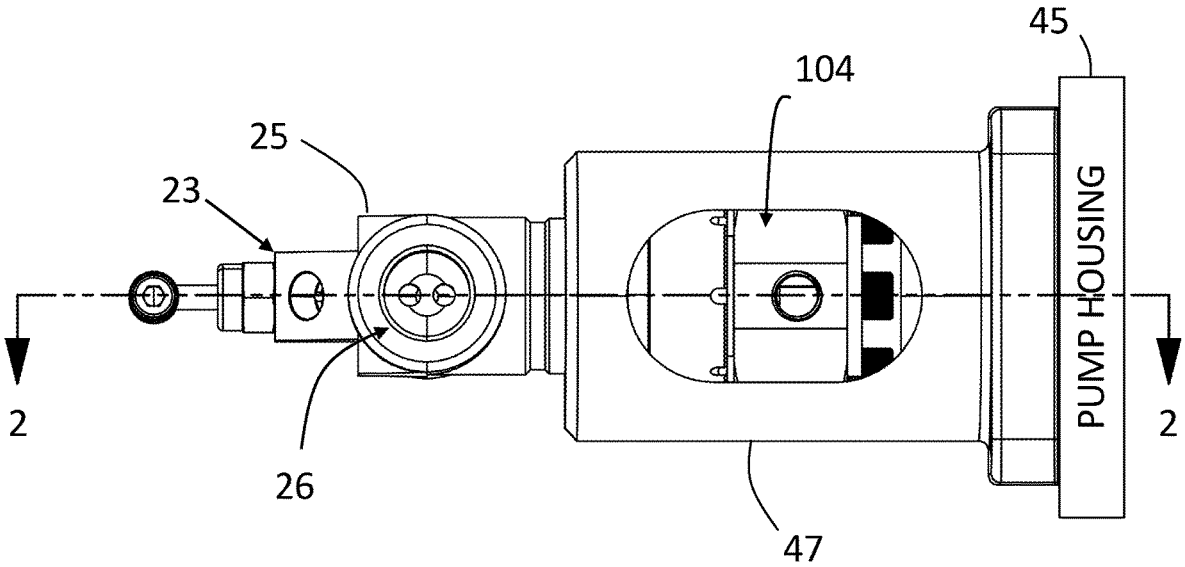
FIG. 4 is a bottom plan view of the fluidic interconnection device of FIG. 2.
Figure 5:
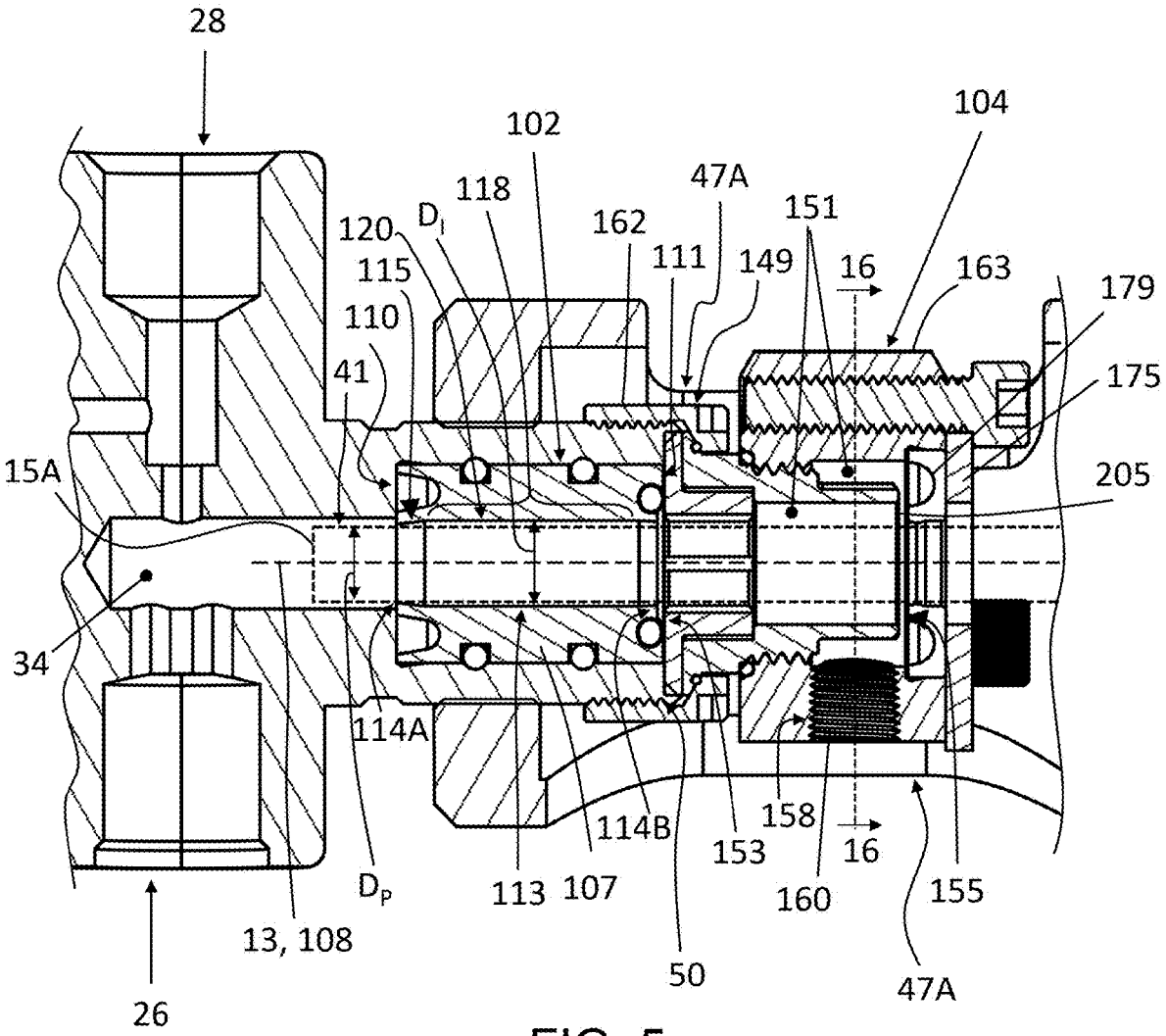
FIG. 5 is an enlarged partial view of an area of FIG. 2 showing a transfer chamber of the fluidic interconnection device and the arrangement of fluid retention apparatus.

Furthermore, with reference to FIGS. 2-4, the pump 10 comprises a pump housing 45 (schematically shown) configured to receive the prime mover 20 and a mounting member 47 configured to support the fluidic interconnection device 23 in fixed relation to the piston 12 and configured for attaching to the pump housing 45. Typically, the mounting member 47 forms a tubular wall which, in a mounted condition in which the member 47 is attached to the housing 45, spans coaxially of the piston 12 from a first proximal end at the pump housing to a second distal end receiving and supporting the fluidic connection device 23. In the mounted condition, the member 47 encompasses a portion of the piston 13 and a portion of the housing 25 of the fluidic interconnection device that includes the packing chamber 37.

Thus is provided a positive displacement pump 10 with a plunger 12 and a transfer chamber 34 disposed intermediate the supply 1 and the target 2 relative to the flow of fluid therebetween.

Turning now to the fluid retention apparatus 100, and with reference to FIGS. 5-8, this is an assembly comprising two devices: (i) a sealing device 102 for resisting leakage of the fluid from the transfer chamber and (ii) a leak containment device 104 for containing leaked fluid that has passed the sealing device.

Turning initially to the sealing device 102, the device 102 comprises a tubular body 107 and extending along an axis 108 from a first end 110 to a second end 111. The tubular body 107 is configured for insertion into the packing chamber 37. That is, the tubular body is sized and shaped to be received in the packing chamber. The packing chamber 37 is substantially cylindrical, specifically circular cylindrical, and open at one end 50 thereof distal to the transfer chamber to form an access opening for matable insertion of the tubular body of the sealing device. Since the packing chamber is substantially cylindrical in shape, the axially opposite ends 110, 111 of the body 107 are substantially planar, and at least the first end 110 is so, to substantially butt against an end wall of the packing chamber proximal to the transfer chamber.

The tubular body 107 is a unitary body of a homogenous material, specifically a composite polymeric material which is wearable and substantially resistant to deformation under mechanical pressure. That is, the composite polymeric material is substantially rigid with a prescribed hardness permitting wear by physical contact therewith, for example rubbing due to sliding contact. The material may also be worn by force-fitting into a premanufactured opening formed therein an element sized slightly larger than the opening. The composite polymeric material is substantially resistant to deformation under mechanical pressure in that the material retains its predetermined or manufactured shape even under consistent yet large force. In the illustrated arrangement, the composite polymeric material comprises polytetrafluoroethylene substantially reinforced with carbon. The material is substantially reinforced with carbon in that there may be other additive materials in the composite polymer material but these are in minority ratios to the polytetrafluoroethylene than a ratio of the carbon thereto. In other words, the composite polymeric material is primarily polytetrafluoroethylene, meaning a majority portion of the material is polytetrafluoroethylene, and a minority portion thereof is carbon. Polytetrafluoroethylene is commonly known as Teflon™.

Also, since the tubular body 107 of the illustrated arrangement, which is particularly suited for use in a chemical injection pump, may be exposed to the pumped fluid, the composite polymeric material is adapted to be chemically nonreactive with a plurality of different types of fluid which may be pumped. For example, in application in the oil/gas industry, constituent materials of the composite polymeric material are selected to be chemically nonreactive to the most common chemicals used in this application.

The sealing device 102 comprises a passageway 113 in the tubular body 107 and extending along the axis 108 thereof. The passageway 113 opens at 114A, 114B at the first and second ends 110, 111 of the tubular body and is configured to receive the piston 12 therethrough. More specifically, the passageway is configured to substantially matably receive the piston, that is it is sized and shaped to substantially match the size and shape of the piston, so as to enhance sealing therebetween, as will be better appreciated later.

Figure 6:
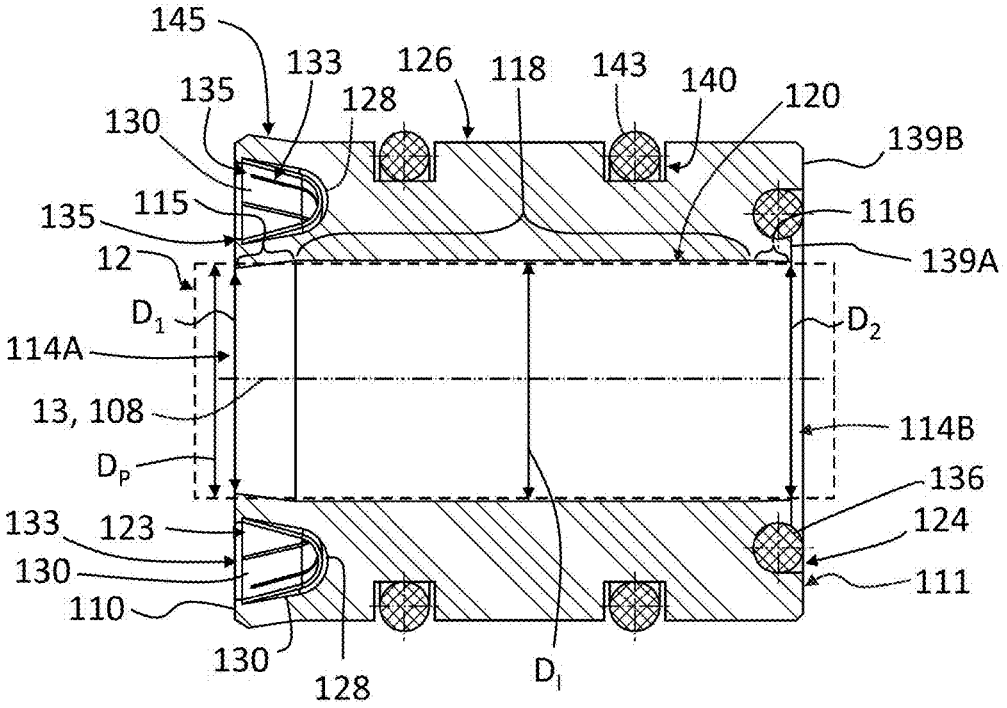
FIG. 6 is an axial cross-sectional view of a sealing device of the arrangement of fluid retention apparatus of FIG. 2, as if it were taken along line 2-2 in FIG. 4, and showing a portion of a piston of the pump in phantom for clarity of illustration.
Figure 7:
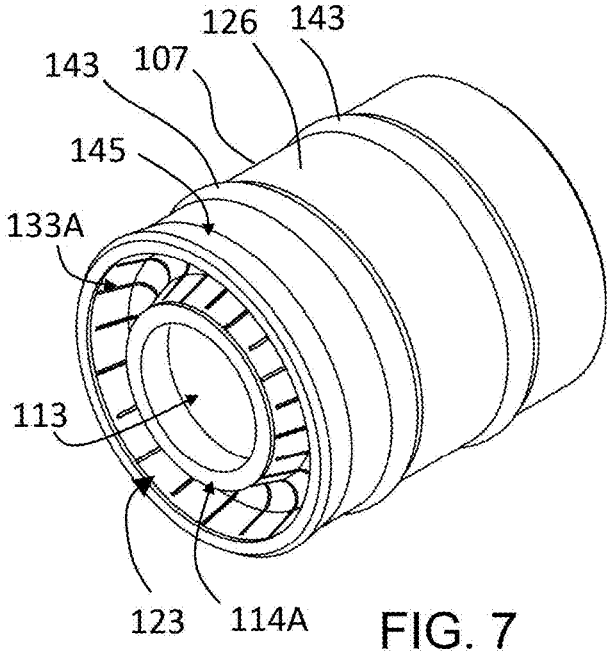
FIG. 7 is a perspective view of the sealing device shown in FIG. 6.
Figure 8:
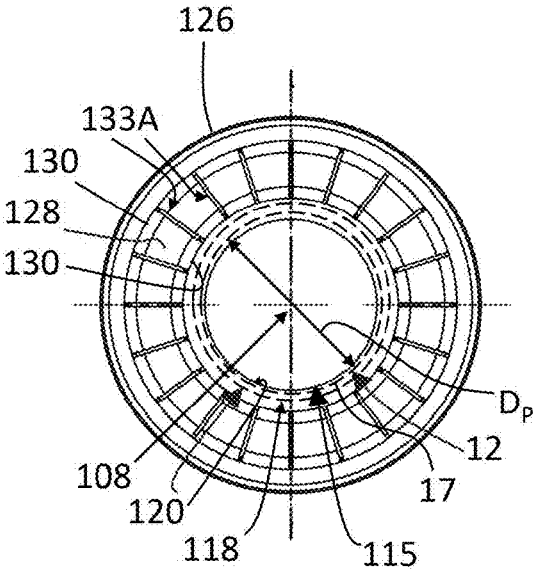
FIG. 8 is an end view of the sealing device shown in FIG. 6, wherein the piston of the pump is shown in phantom for clarity of illustration.

As more clearly shown in FIG. 6, the passageway 113 comprises a first end portion 115 at the first end 110 of the tubular body and defining the first opening 114A; a second end portion 116 at the second end 111 of the tubular body and defining the second opening 114B; and an intermediate portion 118 between the first and second end portions. The intermediate portion 118 is generally cylindrical, that is, the intermediate portion has substantially constant diameter and cross-sectional shape, and the first and second end portions 115, 116 have reduced diameter relative to the intermediate portion. Typically, as in the illustrated arrangement, the passageway has uniform cross-sectional shape along its full length between the opposite ends 110, 111 of the body 107 but different sizes at the various portions.

A diameter $D_I$ of the intermediate portion 118 is sized larger than the diameter $D_P$ of the piston to form a circumferential gap 120 between the intermediate portion of the passageway and the piston. In this manner, there is substantially no contact between the body 107 and the piston at the intermediate portion. However, prescribed diameters $D_1$, $D_2$ of the first and second end portions 115, 116 are sized smaller than the diameter $D_P$ of the piston such that the first and second end portions form seals around the piston by friction fit to resist passage of the fluid. More specifically, insertion of the piston through the passageway causes wearing of the first and second end portions to substantially match the cross-section of the piston to provide a relatively tight fit between these two interfaces of the passageway and the piston.

The device 102 further comprises annular recesses 123, 124 in the first and second ends 110, 111 of the tubular body between the openings 114A, 114B of the passageway and an outer surface 126 of the tubular body arranged to face an interior surface of the packing chamber 37. Each of the annular recesses 123, 124 has a base 128 spaced from a corresponding one of the first and second ends 110, 111 of the tubular body in an axial direction of the tubular body and opposite sidewalls 130 interconnecting the base 128 and the corresponding one of the first and second ends 110, 111 and which are spaced apart in a diametric direction of the tubular body. That is, the annular recesses are endless circumferentially-extending grooves in otherwise substantially planar ends of the tubular body 107.

In association with one of the annular recesses, in this case that indicated at 123, there is provided a biasing device 133 of the sealing device 102 configured to be located in the annular recess in the first end 110. The biasing device has opposite sides 135 configured to be urged apart when the biasing device is in a biased condition. For example, the biasing device is a finger spring arranged to form a closed loop, for example by a series of individual finger springs 133A arranged in spaced relation in a loop-shaped path within the recess 123.

When placed in the annular recess 123 in the first end 110 of the body, the biasing device 133 is arranged in the biased condition with the opposite sides 135 thereof arranged to engage the sidewalls 130 of the annular recess 123 to exert force thereon directed radially of the tubular body 107, whereby the first end portion 115 of the passageway is urged or biased radially inwardly to exert pressure on the piston 12 to enhance the seal therearound for resisting leakage of the fluid from the transfer chamber 34 and into the passageway 113 of the tubular body. In other words, the force exerted by the biasing device on the sidewalls 130 of the recess 123 acts to induce internal stress within the body 107, which is directed in opposite radial directions from the recess or groove 123. This causes the first end portion to be biased radially inwardly towards the piston, enhancing the seal.

When there is one biasing device-receiving recess in the first end 115 in the tubular body 107, the recess 123 is disposed radially centrally between the passageway 113 and the outer surface 126 of the body, such that a distance from an inner one of the sidewalls of the recess, proximal to the passageway opening 114A, and a distance from an outer one of the sidewalls of the recess, proximal to the outer surface, are substantially equal.

In opposite relation to the biasing device 133, there is provided a sealing gasket 136 of the sealing device 102 which is disposed in the annular recess 124 in the second end 111 and configured to form a fluidic seal with a downstream closure component configured to retain the sealing device in the packing chamber 37 by closing the same opposite to the transfer chamber 34. Generally speaking, the closure component is configured to receive the piston therethrough and to abut an end of the body 107 distal to the transfer chamber, that is end 111.

In the illustrated arrangement, the closure component is formed by a fluid-conveying component configured to receive the piston 12 therethrough and to be fluidically communicated with the passageway 113 to receive therefrom the fluid that has leaked from the transfer chamber 34. Upon sealable deformation of the gasket 136, the second end portion 116 of the passageway is urged radially inwards towards the piston 12 to enhance sealing at the interface formed therebetween. In the illustrated arrangement, the gasket 136 is made from an elastomeric material so as to be flexible and resiliently deformable.

In the illustrated arrangement, the prescribed diameter $D_1$ of the first end portion 115 is smaller than the prescribed diameter $D_2$ of the second end portion 116. Thus, there is a tighter fit, and accordingly a higher-pressure interface with the piston, provided at the first end portion than the second end portion. This is because it is desirable for the leaked fluid, which has passed into the passageway 113 from the transfer chamber 34, to be expelled from the passageway at the second opening 114B but resisted from re-entry by the sealing friction fit at the second opening 114B. That way, solids formed as a result of oxidation or crystallization of the leaked fluid are prevented from forming in the passageway and impeding movement of the piston.

In the illustrated arrangement, the first and second end portions 115, 116 are tapered from the diameter $D_I$ of the intermediate portion to the prescribed diameters $D_1$, $D_2$ thereof. As such, the passageway is generally frustoconical in shape at the end portions.

Since the first end portion 115 is tapered, the inner sidewall of the recesses is inclined relative to the axis 108 so as to be generally parallel to the first end portion 115, so as to provide a substantially uniform thickness of constituent material of the body therebetween in the radial direction, through which pressure is applied from the biasing device 133.

In the illustrated arrangement, the first end portion 115 is tapered over a larger axial distance than the second end portion 116. As such, the first end portion is longer along the axis 108 of the tubular body 107 than the second end portion 116. Thus, there is a larger surface area for sealing against the piston at the first end portion as it is primarily desirable to resist admittance of the pumped fluid into the passageway, and secondarily, it is desirable to retain the leaked fluid out of the passageway once it is released therefrom.

It will be appreciated that the opening 114B of the passageway 113 at the second end 111 of the body is recessed from the end 111 relative to the body axis 108. An intervening or intermediate portion surface 139A of the end 111 is planar and coplanar with a planar end face 139B defining the terminus of the body at end 111. This enables sufficiently aggressive tapering of the second end portion 116 of the passageway to the prescribed diameter $D_2$ while providing a larger surface for the gasket 136 to seal against the downstream component.

To maintain the sealing device 102 in fixed relation in the packing chamber 37 against reciprocating movement of the piston 12, the tubular body 107 includes one or more annular recesses 140 at axially spaced locations on the outer surface 126 of the tubular body and one or more sealing gaskets 143 received therein and arranged for engaging the packing chamber 37.

In conjunction therewith, an end portion 145 of the outer surface 126 of the tubular body at the first end 110 is flared outwardly to an outer diameter sized larger than a diameter of the packing chamber which is cylindrical, so as to seal with the packing chamber by friction fit. The biasing device 133 in the first annular recess 123 also acts to urge an outer portion of the body, disposed radially outwardly of the recess 123, against the packing chamber 37 to enhance engagement therein. Since the end portion 145 is tapered, the inner sidewall of the recesses is inclined relative to the axis 108 so as to be generally parallel to the first end portion 115, so as to provide a substantially uniform thickness of constituent material of the body therebetween in the radial direction. Therefore, flaring of the outer surface at this location on the body 107 acts to provide a substantially uniform thickness of material between the annular recess in the first end and the outer surface of the tubular body. As such, the tubular body 107 is wedged into the packing chamber 37 to be retained in fixed position and location therein.

This acts to leave a substantially uniform thickness of material between a respective one of the annular recesses 123, 124 and a corresponding one of the end portions 115, 116 of the passageway, through which pressure is applied from the biasing device 133 and sealing gasket 136 received in the annular recesses.

Figure 9:
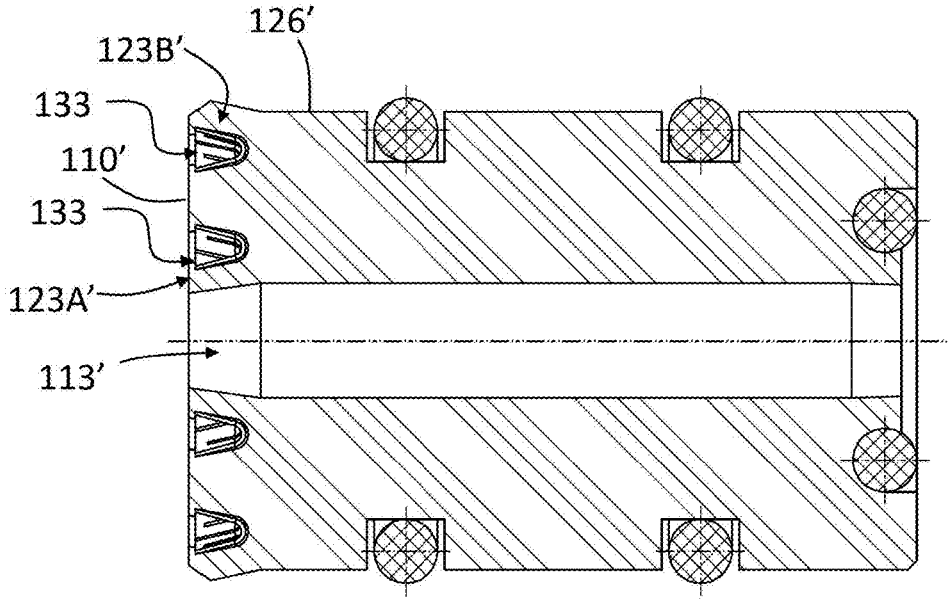
FIGS. 9-11 are cross-sectional, perspective and end views, similar to FIGS. 6-8, but showing another arrangement of sealing device, and where the cross-sectional view is taken along line 9-9 in FIG. 11.
Figure 10:
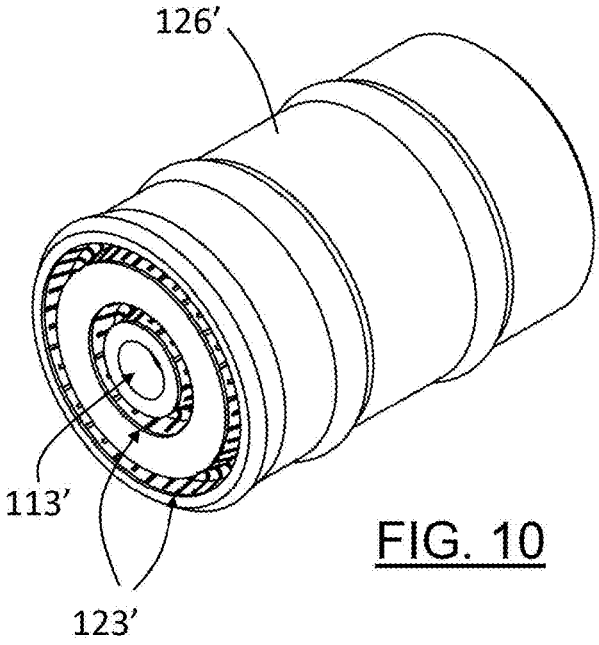
Figure 11:
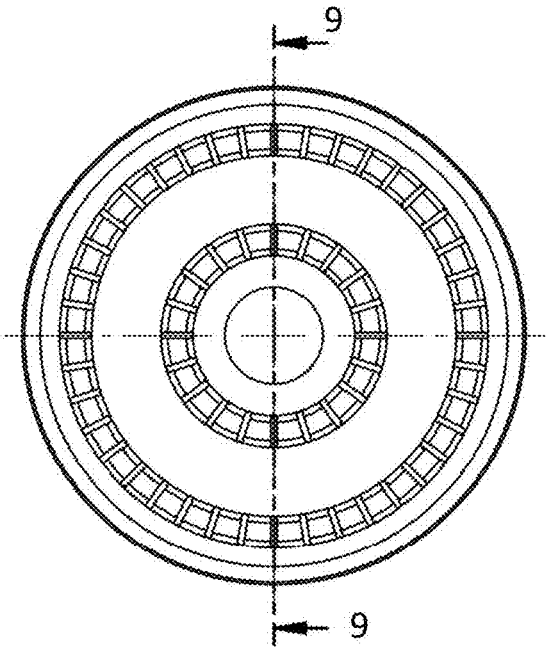

In other arrangements of sealing device, such as that shown in FIGS. 9-11, a first end 110' of tubular body 107' has a plurality of annular recesses, in this case two indicated at 123A' and 123B', located outwardly of passageway 113', and in the illustrated arrangement, the recesses 123A', 123B' are in concentric relation to one another. An inner one of the recesses 123A' proximal to the passageway 113' and distal to an outer surface 126' of the body 107' is disposed closer to the passageway 113' than to the other, outer one of the recesses 123B' proximal to the outer surface 126' and distal to the passageway 113'. Similarly, the outer recess 123B' is disposed closer to the outer surface 126' than to the inner recess 123A'. Each of the recesses receives a distinct biasing device 133 which operates in the same manner as that described with respect to the earlier arrangement of sealing device. Thus, the biasing device in the inner recess 123A' acts on the passageway 113' while the biasing device in the outer recess 123B' acts on the outer surface 126' of the body 107'. Also, in the illustrated arrangement, the passageway 113' is narrower than that of the arrangement shown in FIGS. 6-8 and accordingly corresponds to a piston of suitably corresponding diameter.

Turning now to the second portion of the fluid retention apparatus assembly, and referring back to FIG. 5 where this is more clearly shown, the leak containment device 104 is disposed downstream of the sealing device relative to a flow of leaked fluid in the fluidic interconnection device 23, which is directed from the transfer chamber to the packing chamber. More specifically, the leak containment device 104 is disposed adjacent the sealing tubular body 107 and in opposite relation to the transfer chamber 34. Furthermore, the leak containment device 104 is typically disposed externally of the packing chamber which is reserved for sealing arrangements such as the device 102. The leak containment device 104 is supported in adjacent, downstream relation to the sealing device 102 by mounting a housing 149 thereof to the housing 25 of the fluid interconnection device, which has an open end 50 at the distal end of the packing chamber 37 to the transfer chamber 34. In the illustrated arrangement, the containment housing 149 is threadably mounted to the fluid interconnection device housing 25.

The leak containment device 104 comprises a cavity 151 in the housing 149 configured to receive the piston 12 therethrough and for fluidic communication with the passageway 113 of the sealing body 107 and to receive the fluid that has leaked into the passageway 113 from the transfer chamber. The cavity 151 extends along an axis, which when inserted into the packing chamber 37 is the same axis 108 as that of the sealing device 102, from an open end 153 arranged in fluidic communication with the passageway 113, specifically the second opening 114B thereof, and a substantially closed end 155 forming a substantially sealed interface with the piston.

Furthermore, the leak containment device includes a drain port 158 in fluidic communication with the cavity 151 and configured for selectively communicating the cavity with an external vessel for receiving the fluid that has leaked.

The drain port 158 forms a passageway 160 in communication with the cavity 151 and extending transversely relative to the axis of the leak containment device arranged to be coaxial with the axis 108 of the tubular body.

In the illustrated arrangement, the containment housing 149 comprises a first fixed portion 162 and a second rotatable portion 163 collectively forming the cavity 151. The first fixed portion 162 defines the open end 153 and the second rotatable portion 163 locates the drain port 158 which is disposed at a radially spaced location from the axis 108 of the housing, and the second rotatable portion 163 is rotatably supported on the first fixed portion 162 for rotation around the axis of the fixed portion to reposition the drain port 158 angularly thereof.

Figure 12:
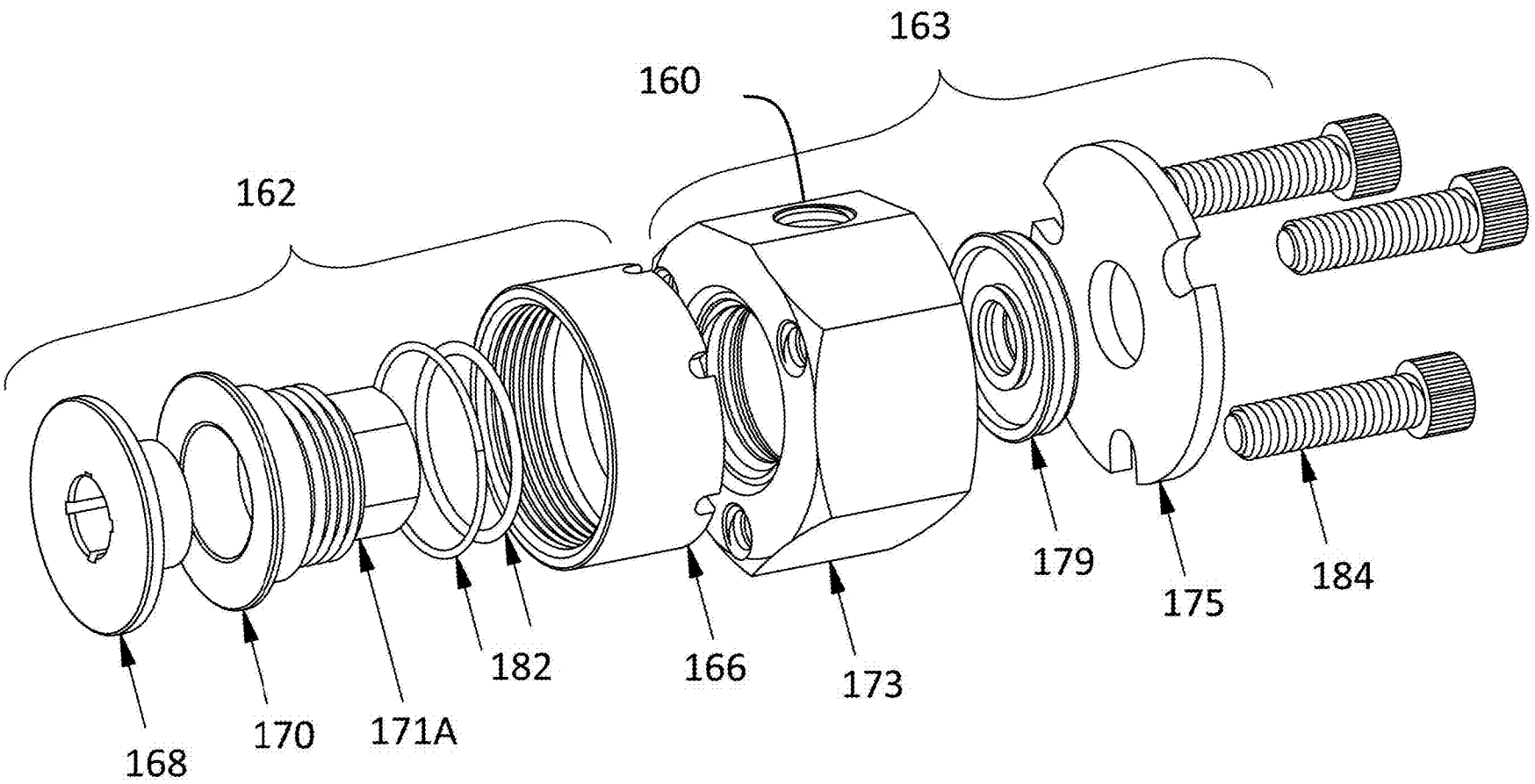
FIG. 12 is an exploded view of the leak containment device of the arrangement of fluid retention device shown in FIG. 2.

As shown more clearly in FIG. 12, the first fixed portion 162 comprises an assembly of a coupler 166 configured to attach to a corresponding packing chamber end 50 of the housing of the fluid interconnection device 23; a bushing 168 for providing a sealing surface to engage the gasket 136 in the second end 111 of the sealing device 102; a pivot adapter 170 receiving the bushing 168 and having a tubular end portion 171A forming an axis of rotation for the second rotatable portion 163. The bushing 168, which delimits an initial or leading portion of the cavity 151 that receives leaked fluid released from the sealing device, has a substantially planar end face and an opening therein with an inner diameter substantially equal to that of the passageway 113, more specifically that of the intermediate portion which is indicated at $D_I$. This reduces likelihood of deformation of the body 107 by providing a surface, in this case the end face of the bushing, for substantial abutment by the end 111 of the body 107. The second rotatable portion 163 comprises a collar 173 rotatably mounted on the pivot adapter of the first fixed portion and locating a passageway for the drain port; an end cap 175 to close a distal end of the collar relative to the first end portion; and a sealing device 179 to seal an interface between the piston and the end cap and so as to close the cavity thereat. There are provided polymeric sealing gaskets 182, specifically polytetrafluoroethylene, to be received on the pivot adaptor for fluidically sealing with the second rotatable portion. FIG. 12 also shows fasteners 184 used to support the end cap in the closed position on the collar 173.

Figure 13:
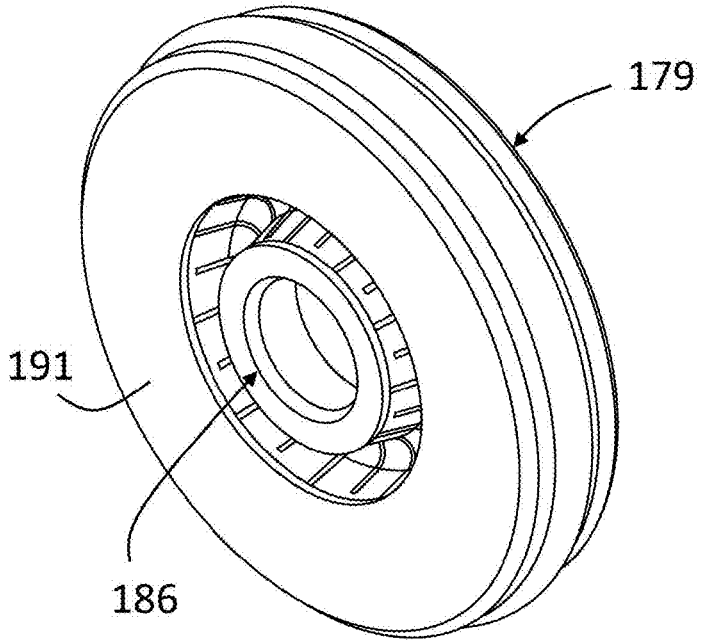
FIGS. 13-15 are perspective, end and cross-sectional views of a sealing device of the leak containment device of FIG. 2.
Figure 14:
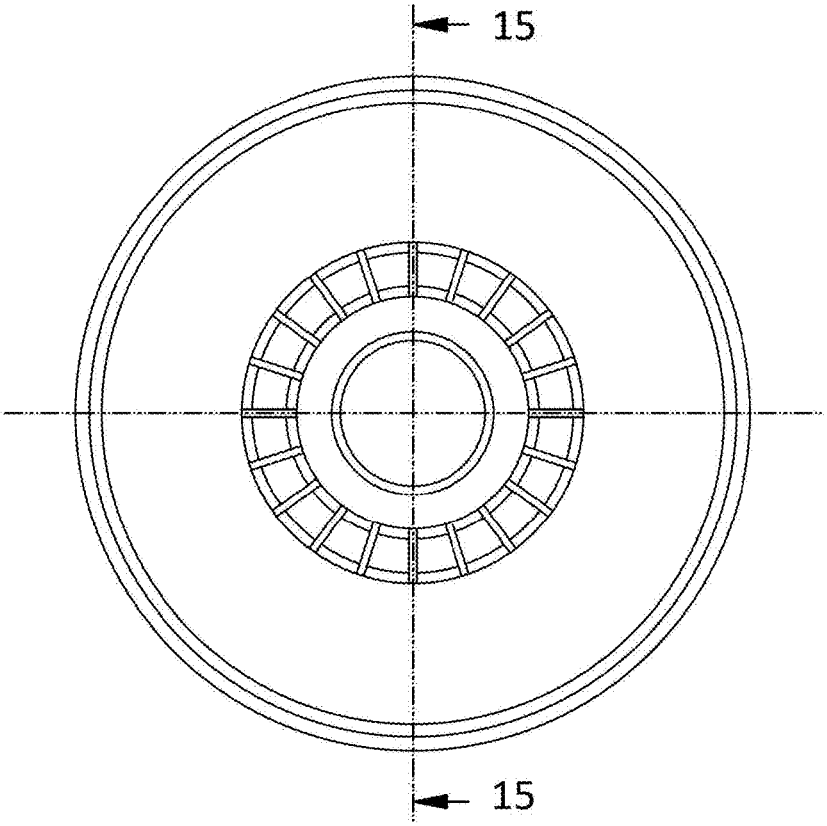
Figure 15:
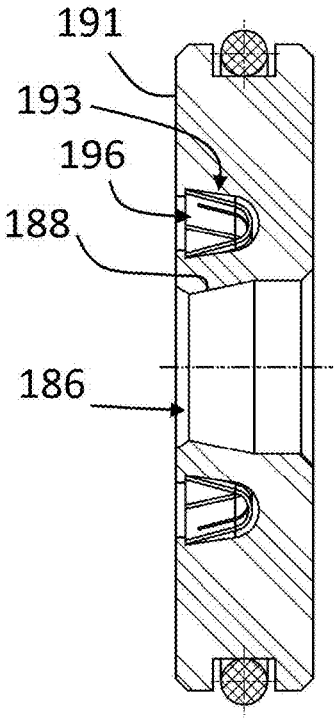
Figure 16:
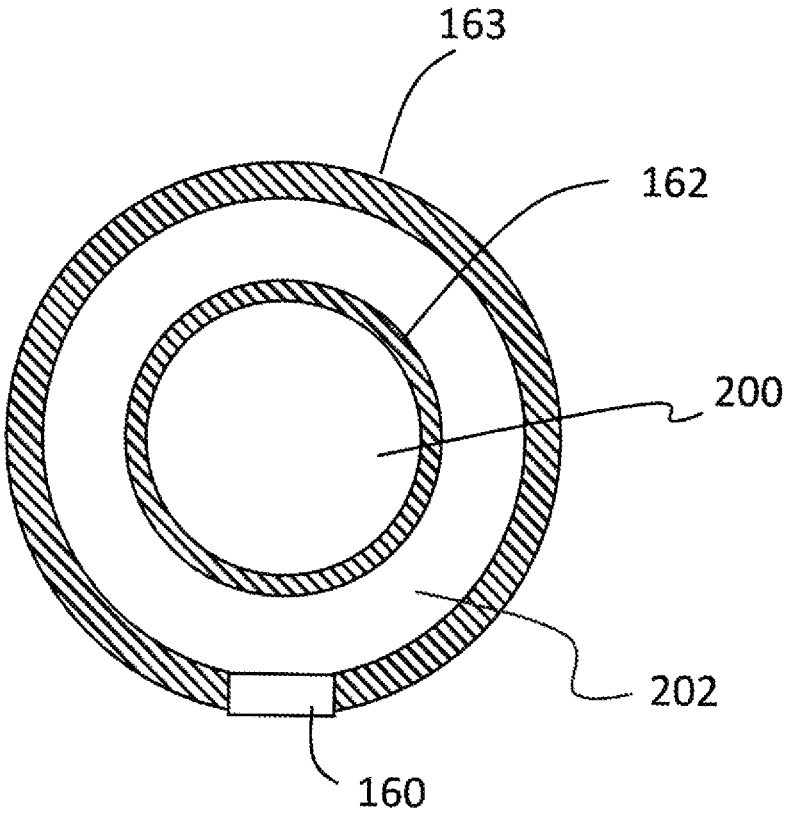
FIG. 16 is a schematic cross-sectional view along line 15-15.

It will be appreciated that the sealing device 179, which is shown more clearly in FIGS. 13-15, is of a similar construction as sealing device 102. Since an axial depth or length of the device 179 is much shorter than that of the device 102, and since fluid is not intended to pass through a piston-receiving passageway 186 of the device 179, there is provided only one end portion 188 of the passageway, which is that adjacent the cavity 151, which is tapered to a diameter smaller than the piston 12, for fluidically sealing engagement therewith, and only one end 191 of the device body, which is that exposed to the cavity 151, with an annular recess 193 receiving a biasing device 196 for inducing internal stress to enhance the sealing action at the tapered end portion 188 thereof.

Due at least in part to the construction of the leak containment device, as more clearly shown in FIG. 12, the cavity 151 comprises an inner portion 200 primarily formed by the fixed housing portion 162 and an outer portion formed 202 formed between the fixed and rotatable housing portions 162, 163. The inner and outer portions are fluidically intercommunicated between a free internal end 205 of the fixed portion (see FIG. 5), defined by the pivot adapter, and the sealing device 179.

In conjunction with the rotatatably repositionable drain port oriented transversely to the housing axis at 108, the mounting member 47 of the pump has an opening 47A in its tubular wall for accessing the drain port 158. In the mounted condition, the opening 47A faces downwardly so that the leaked fluid is drainable from the cavity 151 by gravity. In the illustrated arrangement, the opening 47A comprises a pair of diametrically opposite openings, so that the member 47 is bidirectional.

In other arrangements in which the leak containment device is not used, there is provided an end cap for mounting on the fluidic interconnection device housing to close the packing chamber opposite to the transfer chamber. This end cap has a design that is basically a combination of coupler 166 and bushing 168, so as to provide a surface, facing the end 111 of the body 107, with an opening substantially equal to the diameter of the passageway, for abutment against the end 111.

This provides an arrangement for sealing the piston against flow of the fluid through the passageway of the sealing body in a manner which self-increases sealing pressure as an inner surface of the passageway, particularly at the first end portion, wears during reciprocal movement of the piston.

Also, this provides an arrangement for containing leaked fluid to prevent spills thereof into an ambient environment of the pump.

There is also disclosed herein a method for containing fluid during transfer from a supply to a target using a positive displacement pump, which generally comprises the steps of:

- resisting, using a sealing device 102 received coaxially of the plunger 12 outside the transfer chamber 34, leakage of the fluid out of the transfer chamber, and
- guiding, using a fluid-conveying component in fluidic communication with the passageway of the sealing device and remote to the transfer chamber, a leaked portion of the fluid to an external vessel to be contained therein.

The sealing device 102 has a passageway 113 through which the plunger is passed and in frictional circumferential engagement with an outer surface 126 of the plunger to form a seal therearound.

Preferably, as in the illustrated arrangement, the external vessel is the supply such that the leaked portion of the fluid is reintroduced for subsequent transfer to the target.

In this manner, the pumping system is closed, including with respect to leaked fluid.

There is also disclosed herein a method of forming a seal around a piston of a pump, which generally comprises:

- providing a tubular body with a passageway made of a wearable composite polymeric material, wherein the passageway is sized to substantially matably receive the piston and wherein end portions of the passageway are sized smaller in diameter than the piston;
- providing in an annular recess in an end of the tubular body a biasing device arranged to apply a radially inward circumferential pressure; and
- forcibly passing the piston through the passageway to (i) stretchaby deform a peripheral wall of the passageway such that portions of end portions of the passageway substantially conform to the piston thereby forming seals with the piston and (ii) to compress a radially intervening portion of the tubular body between the passageway and the annular recess, thereby compressibly loading the biasing device, so that it reacts to urge the intervening portion of the tubular body against the piston to enhance sealing at the corresponding end of the body.

It will be appreciated that the deformation caused by passing the piston through the passageway is substantially permanent such that the passageway does not return to its original shape.

As described hereinbefore, the sealing device 102, which may be referred as a cartridge, is inserted into a fluid end of a chemical injection pump and replaces a stacked series of chevron style V-rings which are adjustable for providing different amounts or degrees of sealing pressure through variation of compression of the matably stacked V-rings.

Teflon™ is a base material that has excellent chemical compatibility however unlike elastomers Teflon has the undesirable characteristic of cold flowing which is changing shape under pressure and not returning to its original form. The non-adjustable cartridge is made from a highly modified form of Teflon™ with reinforcing carbon, which reduces cold flowing, but the material will not stand up to the pressures generated in 5100 series fluid ends. The illustrated arrangement of cartridge above uses a stainless-steel laser cut finger spring to provide exaggerated seal on the high pressure side of the cartridge which is disposed at the transfer chamber 34, therefore a single sealing area such as that provided by the first end portion may be used in place of as many as six stacked chevron style rings. The spring-loaded mechanical aspect ensures the modified Teflon does not have a chance to cold flow or change shape and the modified Teflon is chemically compatible with a plurality of different types of chemicals used within the oil and gas production industry. The need for the development of this technology is exacerbated by new compositions introduced to the oil and gas production industry, these chemicals are highly effective in reducing corrosion inside pipelines and pressure vessels but they are very difficult to reliably pump. They are flammable and toxic with a wide range of chemical constituents that are chemically incompatible with most elastomers AND these chemicals show an affinity for metal surfaces, that is the chemicals often stick or adhere to metal surfaces of the pump. This sticking characteristic creates a need for a wiper ring on the low pressure of the cartridge opposite the spring end. The wiper ring is made to scrape the chemical off the critical components of the fluid end which will reduce the damaging effect of the adhered chemical for chemical injection components.

In other words, the cartridge acts a replacement for chevron style packing rings made from elastomeric material. The body of the cartridge, which is exposed to the chemical being transferred through the pump, is made from Polytetrafluoroethylene substantially reinforced with carbon. Thus, the body is substantially rigid so as not to be flexible. The body includes a passageway through which a piston of the pump passes in coaxial relation to the passageway. A first end portion of the body, which is arranged to be exposed to fluid flowing from the pump and under a relatively high pressure, receives in a recess in an end face of said end portion a device which applies radial pressure (relative to the axis of the body) on walls of the recess to urge a peripheral wall of the passageway towards the piston thereby enhancing sealing action of the body on the piston. The low-pressure side of the cartridge at an opposite end thereof faces out of the fluid end. When optionally used with a secondary containment system as described in further detail herein, the low-pressure end of the cartridge is fluidically sealed with a packing nut part of the secondary containment.

Thus, there is a single seal in front of a solid mass. The body seats with a spring-loaded seal exposed to the process pressure, in a recess formed therein, a spring-loaded seal which fluidically seal the body with the fluid end of the pump.

The leak containment device 104 is a compact addition to any 5100 series fluid end and will allow the chemical that does escape to be gathered and retained in a secondary tank or fed back to the inlet side of a fluid end. The non-adjustable cartridge is an integral component of the secondary containment system. It is a pivoting design that allows the ⅛" threaded drain port to face downwardly for easy chemical captivation. Chemical that gets past the non-adjustable cartridge can be sent to a tank with a level switch that can send a signal to provide feedback that there is an issue.

The cartridge housed in the fluid end may be captivated by a 1.25-inch diameter UN (Unified Constant Pitch Thread) packing nut that will also retain the pivoting base of the secondary containment. The 1.25-inch diameter UN female threads of the packing nut screws onto the 1.25-inch diameter UN male threads of any 5100 series fluid end. The female threaded packing nut is screwed onto the male threads of the fluid end until the male end comes in contact with the pivot adaptor of the secondary containment system, there is no further adjustment. The system is now installed and should remain in place as is until it is determined that service is required.

When the cartridge leaks, the escaping chemical will spill into the unpressurised sealed inner chamber of the secondary containment body. Secondary containment body has a ⅛-inch NPT (National Pipe Thread) threaded exit port. The port can be used to convey escaping chemical to a holding tank with a level switch to provide users with a signal denoting the need for service.

As described hereinbefore, the present invention relates to a fluid retention apparatus for a positive displacement pump used to transfer fluid from a supply to a target comprises (i) a sealing device configured to be received in a packing chamber of the pump and to matably receive a piston of the pump therethrough that reciprocates in a transfer chamber for generating suction and expulsion of the fluid for transference thereof, and (ii) a leak containment device configured to contain leaked fluid passed from the transfer chamber. The sealing device features a tubular body made of wearable and substantially deformation-resistant composite polymer material and the passageway which is shaped with opposite end portions of reduced diameter to form a sealing friction fit with the piston. The leak containment device features a cavity fluidically communicated with the sealing device's passageway and receiving the piston therethrough, and a drain port in fluidic communication with the cavity for releasing the leaked fluid.

The scope of the claims should not be limited by the preferred embodiments set forth in the examples but should be given the broadest interpretation consistent with the specification as a whole.

The invention claimed is:

1. A fluid retention apparatus for a positive displacement pump, comprising:

a tubular body extending along a body axis from a first end of the tubular body to a second end of the tubular body, wherein the tubular body forms a sealing body configured to be received in a packing chamber of the positive displacement pump adjacent a transfer chamber of the positive displacement pump receiving a piston to move fluid therethrough;

wherein the tubular body is made from a composite polymeric material which is wearable;

a passageway in the tubular body and extending along the body axis thereof, wherein the passageway opens at the first and second ends of the tubular body, as to have first and second openings of the passageway, and is configured to matably receive the piston therethrough, wherein the passageway comprises a first end portion at the first end of the tubular body, a second end portion at the second end of the tubular body, and an intermediate portion therebetween, wherein the intermediate portion is substantially cylindrical and the first and second end portions have respective diameters which are reduced relative to a diameter of the intermediate portion, wherein the diameter of the intermediate portion is configured to be sized larger than a diameter of the piston to form a circumferential gap between the intermediate portion of the passageway and the piston, wherein said respective diameters of the first and second end portions are sized to be configured to form friction-fit seals around the piston to resist passage of the fluid;

one or more annular end recesses in each of the first and second ends of the tubular body between a corresponding one of the first and second openings of the passageway and an outer surface of the tubular body configured to face walls of the packing chamber when the tubular body is received therein, wherein each of the annular end recesses has a base spaced from a corresponding one of the first and second ends of the tubular body in an axial direction of the tubular body, and opposite sidewalls interconnecting the base and the corresponding one of the first and second ends, wherein the opposite sidewalls are spaced apart in a diametric direction of the tubular body;

a biasing device forming a closed loop and respectively disposed within the one or more annular end recesses in the first end, wherein the biasing device has opposite sides which are interconnected and configured to be urged apart in a biased condition of the biasing device, wherein the opposite sides of the biasing device are engaged with the sidewalls of said annular recess in a manner as to subject the biasing device to the biased condition such that the opposite sides exert a force on said sidewalls directed radially of the tubular body, whereby the first end portion of the passageway is urged radially inwardly to exert a pressure on the piston to enhance the seal therearound as to resist leakage of the fluid from the transfer chamber and into the passageway of the tubular body; and an end sealing gasket respectively disposed in the one or more annular end recesses in the second end and configured to form a fluidic seal with a downstream closure component configured to retain the sealing body in the packing chamber.

2. The fluid retention apparatus of claim 1 wherein the composite polymeric material comprises polytetrafluoroethylene substantially reinforced with carbon.

3. The fluid retention apparatus of claim 1 wherein the diameter of the first end portion is smaller than the diameter of the second end portion.

4. The fluid retention apparatus of claim 1 wherein the first and second end portions are tapered from the diameter of the intermediate portion to the respective diameters of the first and second end portions.

5. The fluid retention apparatus of claim 4 wherein the first end portion is tapered over a larger axial distance than the second end portion.

6. The fluid retention apparatus of claim 1 wherein an end portion of the outer surface of the tubular body at the first end is flared outwardly as to be configured to seal with the packing chamber by friction fit.

7. The fluid retention apparatus of claim 1, wherein the tubular body further includes one or more annular peripheral recesses at axially spaced locations on the outer surface of the tubular body, and a peripheral sealing gasket received in each of the one or more annular peripheral recesses and arranged for engaging the packing chamber.

8. The fluid retention apparatus of claim 1 further including a leak containment device forming the downstream closure component, wherein the leak containment device forms a cavity configured to receive the piston therethrough and for fluidic communication with the passageway of the tubular body and to receive fluid that has leaked into the passageway from the transfer chamber, wherein the cavity extends along a cavity axis from an open end of the cavity arranged in fluidic communication with the passageway of the tubular body and a substantially closed end of the cavity forming a substantially sealed interface with the piston, and wherein the leak containment device includes a drain port in fluidic communication with the cavity and configured for communicating the cavity with an external vessel for receiving the fluid that has leaked.

9. The fluid retention apparatus of claim 8, wherein the drain port forms a passageway in communication with the cavity and extending transversely relative to an axis of the leak containment device, the axis of the leak containment device being arranged to be coaxial with the body axis.

10. The fluid retention apparatus of claim 8, wherein the leak containment device comprises a first fixed portion and a second rotatable portion collectively forming the cavity, wherein the first fixed portion forms an opening of the cavity configured for fluidic communication with the second opening of the passageway which is at the second end of the passageway, wherein the first fixed portion has an axis arranged to be oriented coaxially with the axis of the tubular body, wherein the second rotatable portion locates the drain port which is disposed at a radially spaced location from the axis of the first fixed portion, and wherein the second rotatable portion is rotatably supported on the first fixed portion for rotation around the axis of the first fixed portion to reposition the drain port angularly of the axis of the first fixed portion.

11. A system comprising the fluid retention apparatus and the positive displacement pump of claim 10, wherein the positive displacement pump includes a pump housing receiving a prime mover for displacing the piston and a mounting member for supporting a fluidic interconnection device in fixed relation to the piston and configured for attaching to the pump housing, the fluidic interconnection device forming the transfer chamber, wherein the mounting member further forms a tubular wall encompassing the leak containment device, and wherein the mounting member includes an opening in the tubular wall for accessing the drain port.

12. A fluid retention apparatus for a positive displacement pump, comprising:

a housing configured to be disposed adjacent a sealing body received in a packing chamber of the positive displacement pump and configured to be disposed in opposite relation to a transfer chamber of the positive displacement pump adjacent the packing chamber and receiving a piston to move fluid therethrough;

a cavity in the housing configured to receive the piston therethrough and for fluidic communication with a passageway of the sealing body sealably receiving the piston therethrough, wherein the cavity is configured to receive fluid that has leaked into the passageway from the transfer chamber, wherein the cavity extends along an axis of the housing from an open end of the cavity configured to be in fluidic communication with the passageway of the sealing body and a substantially closed end of the cavity forming a substantially sealed interface with the piston; and a drain port in fluidic communication with the cavity and configured for communicating the cavity with an external vessel for receiving the fluid that has leaked;

wherein the housing comprises a first fixed portion and a second rotatable portion collectively forming the cavity, wherein the first fixed portion defines the open end of the cavity and the second rotatable portion locates the drain port which is disposed at a radially spaced location from the axis of the housing, and wherein the second rotatable portion is rotatably supported on the first fixed portion for rotation around the axis of the housing to reposition the drain port angularly of the housing.

13. The fluid retention apparatus of claim 12 wherein the drain port forms a passageway in communication with the cavity and extending transversely relative to the axis of the housing, said axis configured to be coaxial with an axis of the sealing body.

14. A system comprising the fluid retention apparatus and the positive displacement pump of claim 12, wherein the positive displacement pump includes a pump housing receiving a prime mover for displacing the piston and a mounting member for supporting a fluidic interconnection device in fixed relation to the piston and configured for attaching to the pump housing, the fluidic interconnection device forming the transfer chamber, wherein the mounting member further forms a tubular wall encompassing the housing of the fluid retention apparatus, and wherein the mounting member includes an opening in the tubular wall for accessing the drain port.

* * * * *